US009236678B2

(12) United States Patent
Joo et al.

(10) Patent No.: US 9,236,678 B2
(45) Date of Patent: Jan. 12, 2016

(54) CONTACT TERMINAL FOR CARD SOCKET

(71) Applicant: Molex, LLC, Lisle, IL (US)

(72) Inventors: Sung-Hyuk Joo, Ansan (KR); In Chull Yang, Ansan (KR)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/305,041

(22) Filed: Jun. 16, 2014

(65) Prior Publication Data

US 2014/0370760 A1 Dec. 18, 2014

(30) Foreign Application Priority Data

Jun. 17, 2013 (KR) ..... 10-2013-0069051

(51) Int. Cl.
*H01R 24/00* (2011.01)
*H01R 13/24* (2006.01)

(52) U.S. Cl.
CPC ..... *H01R 13/2457* (2013.01)

(58) Field of Classification Search
CPC ..... H01R 13/2457; H01R 12/721; H01R 23/7068; H01R 12/7094
USPC ..... 439/630, 325, 946, 907, 908
See application file for complete search history.

(56) References Cited

U.S. PATENT DOCUMENTS 3,233,208 A * 2/1966 Gordon et al. ..... 439/636
4,017,143 A * 4/1977 Knowles ..... 439/873
4,795,374 A * 1/1989 Rishworth et al. ..... 439/634
5,080,613 A * 1/1992 Orui et al. ..... 439/660
6,315,621 B1 * 11/2001 Natori et al. ..... 439/862
6,527,590 B2 * 3/2003 Oguchi ..... 439/630
6,616,466 B2 * 9/2003 Frantum et al. ..... 439/157
6,719,594 B1 * 4/2004 Yuzawa ..... 439/862
6,997,751 B2 * 2/2006 Miyamoto ..... 439/630
8,465,309 B2 * 6/2013 Tsuji et al. ..... 439/188
8,651,893 B2 * 2/2014 Ogura et al. ..... 439/495
2002/0037667 A1 * 3/2002 Oguchi ..... 439/630
2002/0098740 A1 * 7/2002 Ooya ..... 439/630
2005/0181683 A1 * 8/2005 Miyamoto ..... 439/862
2012/0149224 A1 * 6/2012 Tsuji et al. ..... 439/188
2012/0252276 A1 * 10/2012 Zhu et al. ..... 439/630
2013/0316585 A1 * 11/2013 McGrath ..... 439/630

FOREIGN PATENT DOCUMENTS

JP 44-3701 Y1 2/1969
JP 10-74568 A 3/1998
JP 2002-100440 A 4/2002

(Continued)

*Primary Examiner* — Neil Abrams
*Assistant Examiner* — Travis Chambers

(57) ABSTRACT

The Present Disclosure relates to a card socket contact terminal furnished on an electronic apparatus. The card socket contact terminal having a plurality of contact points of the Present Disclosure is a contact terminal that is furnished on the housing of a card socket furnished on an electronic apparatus so as to make contact with a card that holds various data for information. It comprises main terminals that are furnished in a number corresponding to the card terminals furnished on the card so as to make contact with the card terminal, and auxiliary terminals that are each connected to the same card terminal to which the respective main terminal connects and to the respective main terminal. Because it can make a plurality of contacts with a single card terminal, it enables contact with the card terminal via the auxiliary terminal even if the main terminal is damaged.

10 Claims, 6 Drawing Sheets

(56) References Cited

FOREIGN PATENT DOCUMENTS

| | | | |
|---|---|---|---|
| JP | 2003-091700 | A | 3/2003 |
| JP | 3095043 | U | 7/2003 |
| JP | 2010-108880 | A | 5/2010 |
| KR | 20090067581 | | 6/2009 |

* cited by examiner

CONTACT TERMINAL FOR CARD SOCKET

REFERENCE TO RELATED APPLICATIONS

The Present Disclosure claims priority to prior-filed Korean Patent Application No. 10-2013-0069051, entitled "Contact Terminal For Card Socket," filed on 17 Jun. 2013 with the Korean Patent Office. The content of the aforementioned Patent Application is incorporated in its entirety herein.

BACKGROUND OF THE PRESENT DISCLOSURE

The Present Disclosure relates, generally, to a card socket contact terminal furnished on an electronic apparatus, and, more particularly, to a card socket contact terminal having a plurality of contact points so that a plurality of contacts can mate with a single card terminal furnished on a card.

Among the various cards furnished on a mobile telephone, SIM cards are loaded with most of the information needed for operating the telephone. In particular, they are loaded with subscriber personal information such as passwords, in addition to relevant encrypted data including the telephone number, network number, etc. Mobile terminals are thus typically furnished with a SIM card socket in the main circuit board mounted within the terminal, and are designed so that the SIM card makes electrical contact with the SIM card socket.

In the SIM card socket, a contact terminal is furnished, where contact occurs with the card terminal furnished on the SIM card. The card terminal and the contact terminal of the socket have a one-to-one correspondence. As is disclosed in Korean Patent No. 10-0919948, a single contact terminal makes contact with a single card terminal. The content of the '948 Patent is incorporated by reference herein in its entirety. According to the '948 Patent, in the housing there are furnished the same number of contact terminals as are furnished on the SIM card. The contact point part of the contact terminal protrudes from the bottom surface of the housing to make contact with the card terminal of the SIM card. If the same number of contact terminals are furnished on the SIM card socket as on the card terminal furnished on the SIM card, as in the '948 Patent, if some contact terminals furnished on the SIM card socket are damaged then the signals cannot be properly transmitted, leading unavoidably to product malfunction.

SUMMARY OF THE PRESENT DISCLOSURE

The purpose of the Present Disclosure, devised in order to resolve the above-described problems, is to provide a card socket contact terminal having a plurality of contact points that can reliably make contact with the card terminal, by virtue of having a plurality of contact points whereby a plurality of contacts can be made with a single card terminal furnished on the card.

The card socket contact terminal of the Present Disclosure, having a plurality of contact points, is furnished on the housing of a card socket furnished on an electronic apparatus, to make contact with a card that holds various kinds of data or information. The card socket comprises main terminals furnished in a number corresponding to the number of card terminals furnished on the card to make contact with the card terminals, and auxiliary terminals that are each connected both to the same card terminal to which the respective main terminal connects and to the respective main terminal. Because a plurality of contacts can be made with a single card terminal, contact can be made with the card terminal via the auxiliary terminal even if the main terminal is damaged. If the auxiliary terminal undergoes elastic deformation in a vertical direction, the main terminal will also undergo elastic deformation in a vertical direction.

The main terminal and auxiliary terminal comprise an upward tilting part extending from the connecting part that connects the main and auxiliary terminals, formed tilting upward obliquely toward the front end so as to have internal elasticity, and a downward-tilting part that tilts downward obliquely from the front end of the upward-tilting part. The main and auxiliary terminals differ in length and in the height of the contact points. Further, the contact point of the main terminal and the contact point of the auxiliary terminal are formed with different depthwise positions. Additionally, the auxiliary terminal is formed longer than the main terminal. The front end thereof is positioned lower than the front end of the main terminal on the housing.

When mounted in the housing, the front end of the auxiliary terminal is located lower than the internal floor of the housing. Further, the main and auxiliary terminals are formed separately from the front end of the connecting part. Additionally, the main terminal is formed with a shape that narrows to left and right from the part that connects to the connecting part to the part before the contact point.

Of the left and right sides of the main terminal, the side located toward the auxiliary terminal is formed at a tilt, so that the widthwise width of the main terminal is reduced approaching the front end. On the connecting part that connects the main and auxiliary terminals, an elasticity reinforcement hole is formed to facilitate elastic deformation of the main and auxiliary terminals without plastic deformation. The elasticity reinforcement hole is increased in widthwise width toward the front end of each terminal.

The card socket contact terminal having multiple contact points has the following effects. First, because a plurality of contact points with the card terminal are formed due to the contact terminal corresponding to each card terminal furnished on the SIM card being divided into a main terminal and auxiliary terminal, even if the contact status is defective due, e.g., to the main terminal being damaged, a defective connection between the contact terminal and card terminal can be prevented due to the auxiliary terminal also being contact to the card terminal, thus enabling product reliability to be maintained.

Second, because the main terminal is formed narrowing toward its tip and an elasticity reinforcement hole is formed on the connecting part, elastic deformation can be facilitated when the SIM card is inserted into or removed from the card socket, so that plastic deformation of the contact terminal can be prevented. Accordingly, the contact terminal is not plastically deformed and returns elastically to its original state after deformation, enabling product quality to be retained over the long term.

Third, because the auxiliary terminal is formed longer than the main terminal and its end is located lower than the main terminal, and when the auxiliary terminal is mounted on the housing it is located below the interior floor of the housing, when a card adapter to which no card is attached is removed from the inserted position in the card socket, then the card adapter can straightforwardly be removed without catching on either the auxiliary or main terminal.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
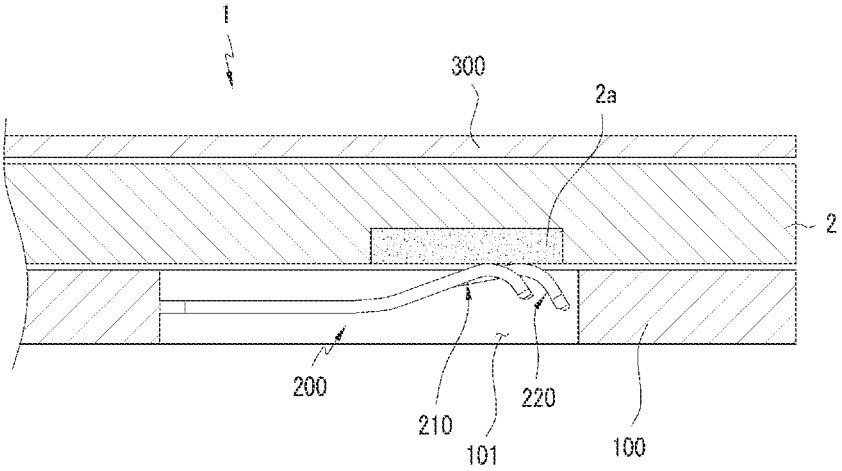
FIG. 1 is a schematic illustration of the state in which a SIM card is inserted into a card socket using a card socket contact terminal having multiple contact points according to an embodiment of the Present Disclosure.
Figure 2:
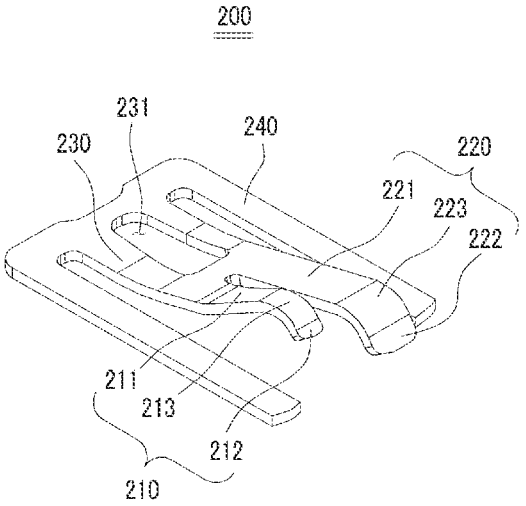
FIG. 2 is an oblique view of the card socket contact terminal of FIG. 1.
Figure 3:
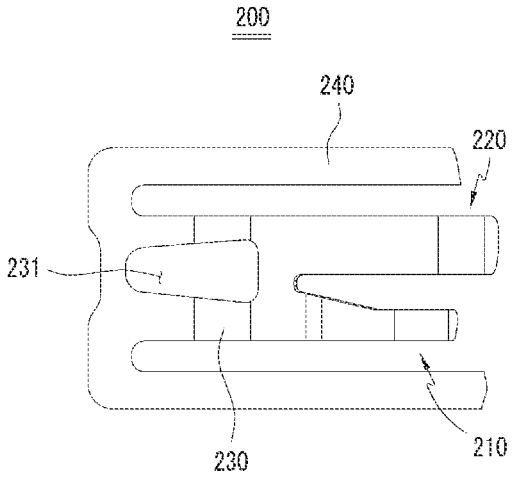
FIG. 3 is a top view of FIG. 2.
Figure 4:
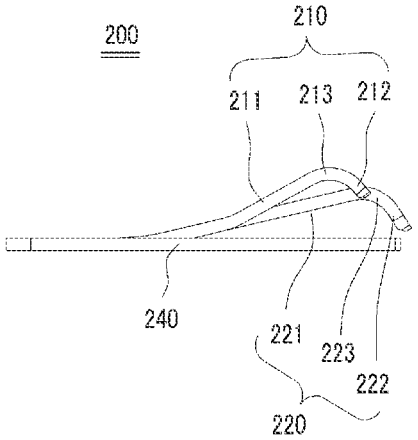
FIG. 4 is a front view of FIG. 1.

Referring to FIG. 1, the card socket 1 comprises a housing 100, contact terminal 200 and metal cell 300. In the housing 100 is formed a terminal deformation hole 101 to enable elastic deformation when the contact terminal 200 is depressed by the SIM card 2 when the SIM card 2 is inserted. The rear end of the contact terminal 200 is embedded in the housing 100. The front end is exposed via the terminal deformation hole 101 of the housing 100 to contact the card terminal 2*a* of the SIM card 2. The contact terminal 200 comprises a main terminal 210 that contacts the card terminal 2*a*, furnished in a number corresponding to the number of card terminals 2*a* furnished on the SIM card 2, and an auxiliary terminal 220 connected to the main terminal 210 so that the connection with the card terminal 2*a* can be maintained even if the main terminal 210 is damaged.

As illustrated, because the main terminal 210 and auxiliary terminal 220 make contact with the same card terminal 2*a* at the same time, the auxiliary terminal 220 maintains its connection with the card terminal 2*a* even if the main terminal 210 is damaged (and also maintaining the connection of the main terminal and card terminal even if the auxiliary terminal is damaged). However, configurations are not limited thereto, and it may also be configured so that only the main terminal 210 makes contact with the card terminal 2*a* and the auxiliary terminal 220 contacts the card terminal 2*a* only if the main terminal 210 is damaged. The contact point of the main terminal 210 and the contact point of the auxiliary terminal 220 are both located on the top of the internal floor of the housing 100 so that they can make contact with the card terminal 2*a* before the SIM card 2 has been inserted.

The contact terminal 200 according to this embodiment comprises a main terminal 210, an auxiliary terminal 220, a connecting part 230 and an embedding part 240. The main terminal 210 comprises a first upward tilting part 211 that has internal elasticity due to being formed tilting upward obliquely toward the front end, a first downward-tilting part 212 extending tilting obliquely downward from the front end of the first upward-tilting part 211 and a first contact point 213 formed at the top end of the first upward-tilting part 211 to contact the card terminal 2*a*. The first upward-tilting part 211 is not formed in a straight line, and is formed in a single upward curve to afford greater elasticity. The auxiliary terminal 220 comprises a second upward tilting part 221 that has internal elasticity due to being formed tilting upward obliquely toward the front end, a second downward-tilting part 222 extending tilting obliquely downward from the front end of the second upward-tilting part 221 and a second contact point 223 formed at the top end of the second upward-tilting part 221 to contact the card terminal 2*a*.

The connecting part 230 connects the rear parts of the main terminal 210 and auxiliary terminal 220, so that the main terminal 210 and auxiliary terminal 220 are bifurcated from the front end of the connecting part 230. The connecting part 230 has an elasticity reinforcement hole 231 to increase the elasticity of the main terminal 210 and auxiliary terminal 220. If the main terminal 210 and auxiliary terminal 220 are deformed, due to this elasticity reinforcement hole 231, they will be smoothly elastically deformed rather than plastically deformed. In particular, because the elasticity reinforcement hole 231 is reduced in widthwise width from the rear toward the front end of each terminal 210, 220, the widthwise width of the part located on the left or right side of the elasticity reinforcement hole 231 is also reduced toward the front end of the respective terminal 210, 220. As a result, elastic deformation is facilitated.

The embedded part 240 extends from the rear of the connecting part 230 toward either side of the main terminal 210 and auxiliary terminal 220, so that if the housing 100 and contact terminal 200 are overmolded, it is embedded and fixed in place in the housing 100. The main terminal 210 is also formed with narrowing widthwise width from the point at which it bifurcates from the connecting part 230 to the part where the second contact point 223 is formed, enabling straightforward elastic deformation. To this end, the side located toward the auxiliary terminal 220 is formed at a tilt.

The second contact point 223 of the auxiliary terminal 220 is located in front of the second contact point 223 of the main terminal 210. The elevation thereof is lower than that of the second contact point 223. In addition, the auxiliary terminal 220 is formed longer than the main terminal 210. The front end of the auxiliary terminal 220 is located below the front end of the main terminal 210.

SIM cards are manufactured and used in diverse sizes, including mini SIM cards, micro SIM cards, and nano SIM cards. Because these cards differ in size, the sizes of the corresponding sockets must also vary accordingly. If respectively different sockets are thus furnished for each card, this becomes a factor increasing the unit cost of the product, so card adapters have been developed and implemented that enable both large and small SIM cards to be used. Specifically, a large SIM card is simply used as-is without an adapter, while a small SIM card is coupled to the card adapter for use. When mobile telephones are shipped, typically they are shipped with a card adapter coupled to the card socket. In addition, in use sometimes a SIM card is not coupled to the SIM card adapter, and only the card adapter is coupled to the card socket.

Figure 5:
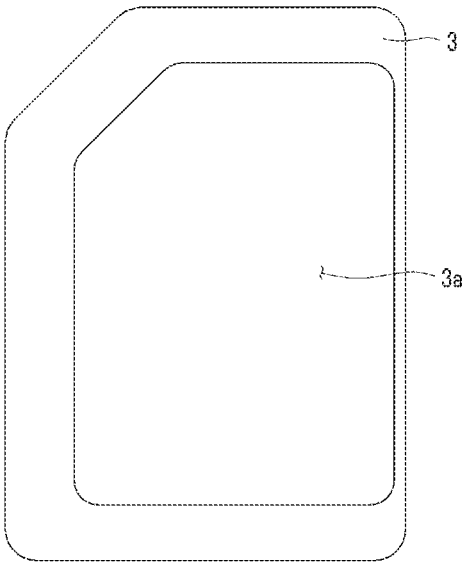
FIG. 5 is a top view of a card adapter according to an embodiment of the Present Disclosure.

As shown in FIG. 5, on the card adapter 3 is furnished a card coupling hole 3*a* for the SIM card to be inserted and coupled. Because the contact terminal is formed tilted in the direction of insertion, when the card adapter 3 is inserted into the card socket, the card adapter 3 can be smoothly inserted without being obstructed by the contact terminal. However, if the card adapter 3 is removed from the card socket, the card coupling hole 3*a* of the card adapter 3 will catch on the front end of the contact terminal and prevent easy separation. In addition, the contact terminal may be deformed and damaged by excessive force being applied during removal. The Present Disclosure is able to resolve these problems by furnishing an auxiliary terminal 220.

Figure 6:
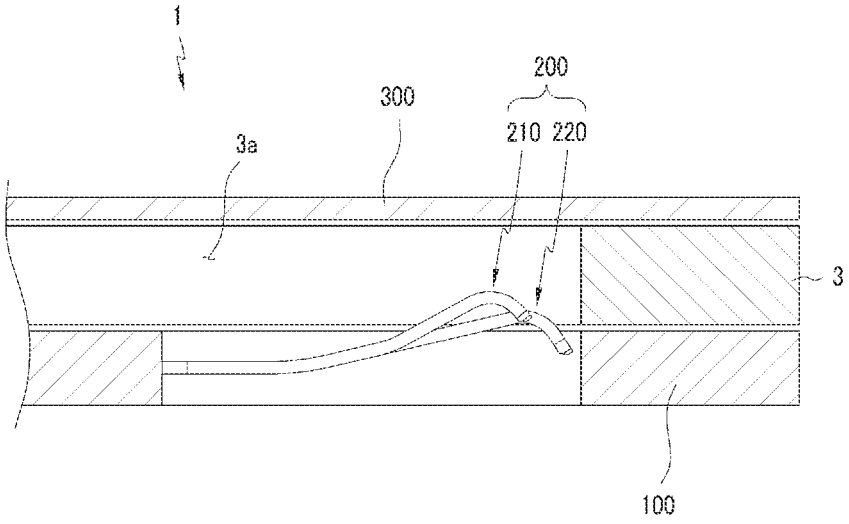
FIG. 6 is an oblique view illusrating the process of removing the card adapter of FIG. 5, previously inserted in the card socket of FIG. 1, wherein a contact terminal is furnished, according to an embodiment of the Present Disclosure, from the card socket.

As shown in FIG. 6, according to the Present Disclosure, when the contact terminal 200 is mounted on the housing 100, the front end of the main terminal 210 is located on the internal floor of the housing 100, and the front end of the auxiliary terminal 220 is located below the internal floor of the housing 100. When the card adapter 3 is coupled to the card socket 1, the edge of the card coupling hole 3*a* does not make contact with the front end of the contact terminal 200. Even when contact is made, it does not make contact with the main terminal 210, but contacts the top surface of the front end part of the auxiliary terminal 220.

Figure 7:
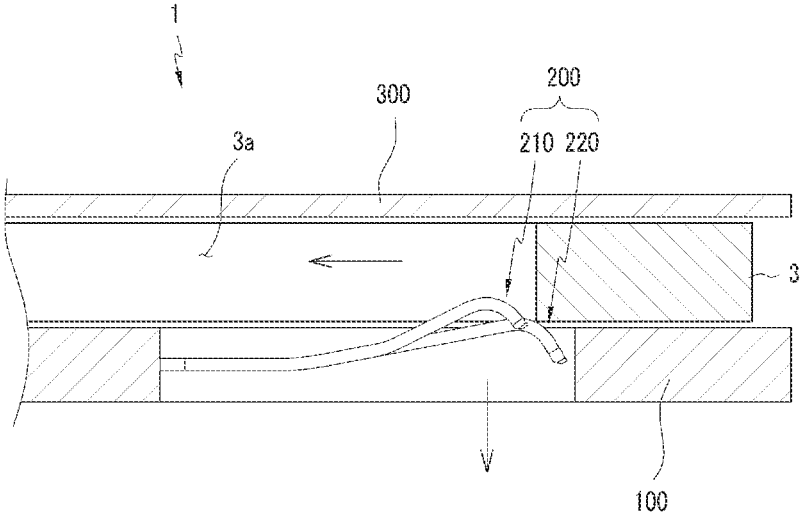
FIG. 7 is another oblique view illusrating the process of removing the card adapter of FIG. 5, previously inserted in the card socket of FIG. 1, wherein a contact terminal is furnished, according to an embodiment of the Present Disclosure, from the card socket.
Figure 8:
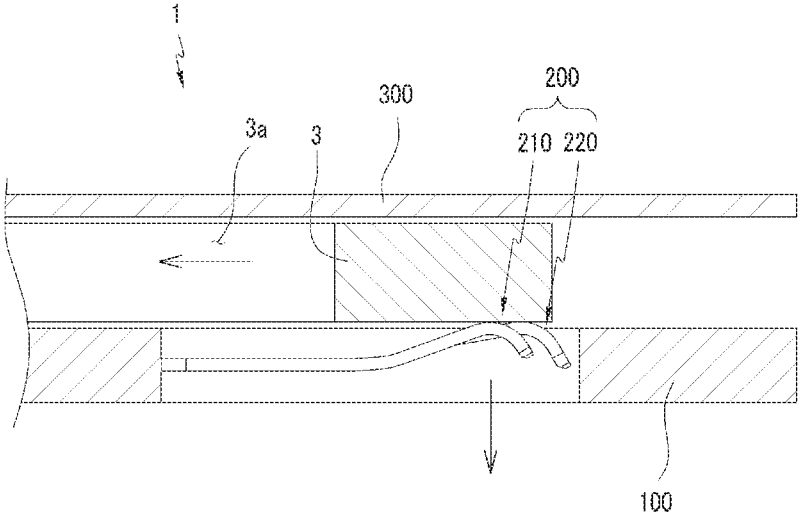
FIG. 8 is another oblique view illusrating the process of removing the card adapter of FIG. 5, previously inserted in the card socket of FIG. 1, wherein a contact terminal is furnished, according to an embodiment of the Present Disclosure, from the card socket.
Figure 9:
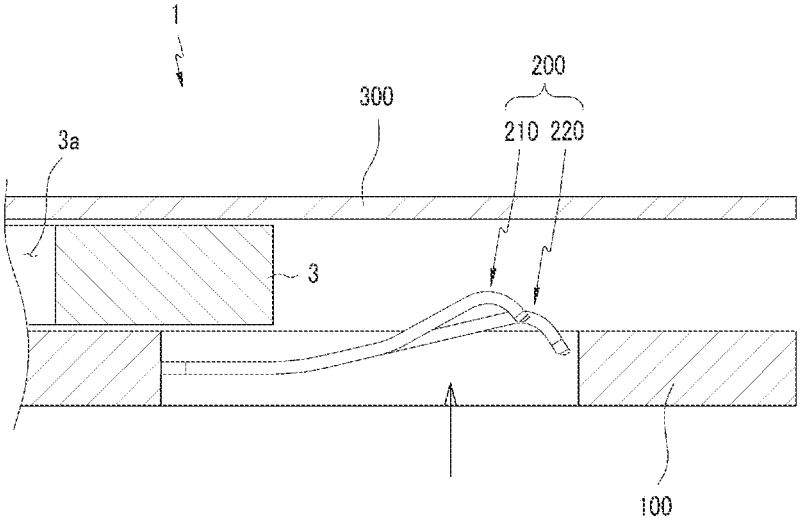
FIG. 9 is another oblique view illusrating the process of removing the card adapter of FIG. 5, previously inserted in the card socket of FIG. 1, wherein a contact terminal is furnished, according to an embodiment of the Present Disclosure, from the card socket.

As shown in FIG. 7, if the card adapter 3 is pulled in order to remove it, the edge of the card coupling hole 3*a* is first contacted to the top surface of the front end of the auxiliary terminal 220 as the auxiliary terminal 220 is pushed downward. If the auxiliary terminal 220 is thus pushed downward, the main terminal 210, which is connected as a single unit with the auxiliary terminal 220, also descends, and the front end thereof descends below the floor of the internal surface of the housing 100. Accordingly, the edge of the card coupling hole 3*a* does not catch on the front end of the main terminal 210. As shown in FIG. 8, if the card adapter 3 continues to be pulled, the area around the card coupling hole 3*a* presses against both the auxiliary terminal 220 and the main terminal 210, thus enabling smooth separation from the card socket 1. As shown in FIG. 9, if the contact terminal 200 is passed in the process of removing the card adapter 3, the contact terminal 200 comprising the main terminal 210 and auxiliary terminal 220 is restored to its original state by its own elasticity.

Figure 10:
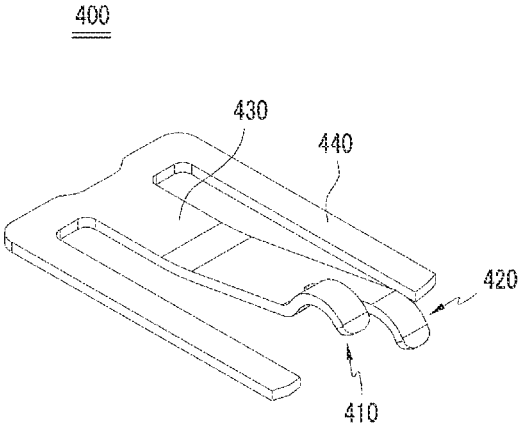
FIG. 10 is an oblique view of a card socket contact terminal having a plurality of contact points according to another embodiment of the Present Disclosure.
Figure 11:
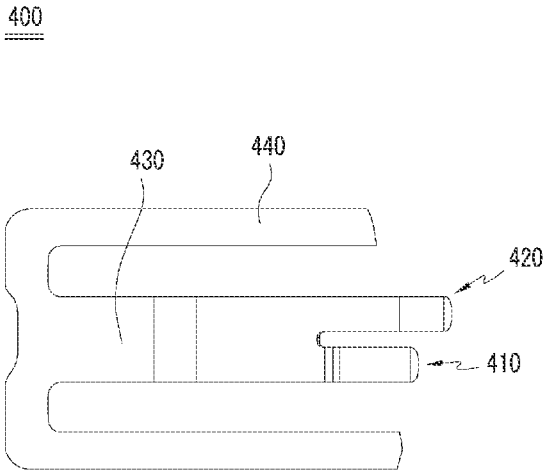
FIG. 11 is a top view of FIG. 10.

Referring to FIGS. 10-1, a card socket contact terminal 400 according to this embodiment comprises a main terminal 410, an auxiliary terminal 420, a connecting part 430 and an embedding part 440. In contrast to the previous embodiment, the card socket contact terminal 400 here has a shape wherein the width of the main terminal 410 remains constant toward the front end. The auxiliary terminal 420 likewise, as in the previous embodiment, maintains a constant width toward the front end. In this embodiment, a separate elasticity reinforcement hole is not formed on the connecting part 430. The embedding part 440 is the same as the embedding part 240 of the previous embodiment.

While a preferred embodiment of the Present Disclosure is shown and described, it is envisioned that those skilled in the art may devise various modifications without departing from the spirit and scope of the foregoing Description and the appended Claims.

What is claimed is:

1. A card socket contact terminal, the card socket terminal comprising:

a plurality of contact points, each contact point being furnished on an electronic apparatus, each contact point contacting a card, the card holding various data or information, the card including a card terminal:

a base for embedding in a connector housing;

at least one main terminal, each main terminal being furnished in a number corresponding to the card terminals, each main terminal extending lengthwise in a cantilevered fashion from the base and terminating in a front end, each main terminal contacting a corresponding card terminal;

at least one auxiliary terminal, each auxiliary terminal being connected both to the same card terminal to which the respective main terminal connects and to the respective main terminal, the auxiliary terminal being spaced apart widthwise from the main terminal and the auxiliary terminal further extending lengthwise in a cantilevered fashion from said base and also terminating in a front end, the auxiliary terminal and main terminal being joined together by a connecting part located between said base and the main and auxiliary terminal front ends, the connecting part further including an elasticity reinforcement hole formed therein and disposed between the base and the main and auxiliary terminals for facilitating elastic deformation of the main and auxiliary terminals without plastic deformation;

each of the main and auxiliary terminals having an upward-tilting part extending obliquely from the connecting part toward the terminal front ends, and each of the main and auxiliary terminals further having a downward-tilting part that extends obliquely downwardly from the upward-tilting parts to the front ends thereof;

whereby contact with said card terminal is possible via said auxiliary terminal even if said main terminal is damaged.

2. The card socket contact terminal of claim 1, wherein, when each auxiliary terminal is elastically deformed in a vertical direction, each corresponding main terminal is also elastically deformed in a vertical direction.

3. The card socket contact terminal of claim 1, wherein the main terminal and contact terminal are formed bifurcating from the connecting part.

4. The card socket contact terminal of claim 1, wherein the main terminal and auxiliary terminal have different lengths and contact point heights.

5. The card socket contact terminal of claim 4, wherein the contact point of the main terminal and the contact point of the auxiliary terminal are formed with different depthwise positions.

6. The card socket contact terminal of claim 1, wherein the auxiliary terminal is formed longer than the main terminal, and the front end thereof is positioned lower than the front end of the main terminal when the card socket contact terminal is mounted in a corresponding connector housing.

7. The card socket contact terminal of claim 6, wherein, when mounted in the connector housing, the front end of the auxiliary terminal is located lower than an internal floor of the connector housing.

8. The card socket contact terminal of claim 1, wherein the auxiliary terminal has a constant width from the connecting part to the auxiliary terminal front end, and the main terminal has a width that varies from the connecting part to the main terminal front end.

9. The card socket contact terminal of claim 8, wherein width of the main terminal narrows from the connecting part to the main terminal front end.

10. The card socket contact terminal of claim 8, wherein the elasticity reinforcement hole a tapered shape that increases in widthwise width toward the front end of each terminal.

* * * * *